US009511469B2

(12) United States Patent
Boon Beng et al.

(10) Patent No.: US 9,511,469 B2
(45) Date of Patent: Dec. 6, 2016

(54) POLISHING ASSEMBLY AND METHOD FOR POLISHING USING A PLATFORM AND BARRIER IN A TUMBLING PROCESS

(71) Applicant: PRATT & WHITNEY SERVICES PTE LTD., Singapore (SG)

(72) Inventors: Chua Boon Beng, Singapore (SG); Thomas Tan, Singapore (SG); Kim Wei Cheah, Singapore (SG); Wai Tuck Chow, Singapore (SG)

(73) Assignee: Pratt & Whitney Services PTE LTD., Singapore (SG)

( * ) Notice: Subject to any disclaimer, the term of this patent is extended or adjusted under 35 U.S.C. 154(b) by 642 days.

(21) Appl. No.: 13/655,609

(22) Filed: Oct. 19, 2012

(65) Prior Publication Data

US 2013/0323071 A1 Dec. 5, 2013

(30) Foreign Application Priority Data

Jun. 1, 2012 (SG) ..... 2012040689

(51) Int. Cl.

| | |
|---|---|
| ***B24B 31/00*** | (2006.01) |
| ***B24B 31/12*** | (2006.01) |
| ***F01D 25/28*** | (2006.01) |
| ***B24B 31/06*** | (2006.01) |

(52) U.S. Cl.

CPC ..... *B24B 31/003* (2013.01); *B24B 31/064* (2013.01); *B24B 31/12* (2013.01); *F01D 25/285* (2013.01); *F05D 2230/18* (2013.01); *F05D 2250/621* (2013.01); *Y10T 428/31* (2015.01)

(58) Field of Classification Search

CPC ..... B24B 31/003; B24B 31/06; B24B 31/064; B24B 31/00; B24B 19/14; F01D 25/285; F01D 2230/18; F01D 2250/621

USPC ..... 451/29; 269/100, 43, 900, 903, 289 R

See application file for complete search history.

(56) References Cited

U.S. PATENT DOCUMENTS

| | | | | |
|---|---|---|---|---|
| 253,192 | A | 2/1882 | Pelton | |
| 3,691,691 | A | 9/1972 | Smith | |
| 4,271,005 | A * | 6/1981 | Wright et al. | 204/298.15 |
| 4,447,992 | A * | 5/1984 | Bergquist | 451/326 |
| 5,165,859 | A | 11/1992 | Monroe | |
| 5,182,855 | A * | 2/1993 | Martin | 29/889.22 |
| 5,214,883 | A | 6/1993 | Naumec et al. | |
| 5,251,409 | A * | 10/1993 | Orbank | 451/37 |
| 5,486,261 | A * | 1/1996 | Kikuchi | B29D 30/48 156/422 |
| 5,538,461 | A * | 7/1996 | Tseng | B24B 31/12 451/113 |
| 5,565,035 | A * | 10/1996 | Sylvestro | C23C 14/042 118/301 |

(Continued)

OTHER PUBLICATIONS

International Search Report for International Application No. PCT/US2013/040840 dated Aug. 23, 2013.

(Continued)

*Primary Examiner* — Joseph J Hail
*Assistant Examiner* — Arman Milanian
(74) *Attorney, Agent, or Firm* — Carlson, Gaskey & Olds, P.C.

(57) ABSTRACT

An example component polishing method includes polishing a component protecting portions of the component during the polishing using a barrier spaced from the component. The barrier is configured to move together with the component during the polishing.

17 Claims, 5 Drawing Sheets

(56) References Cited

U.S. PATENT DOCUMENTS

| | | | | |
|---|---|---|---|---|
| 5,869,194 | A * | 2/1999 | Dwyer | 428/542.8 |
| 5,916,638 | A | 6/1999 | Zajchowski et al. | |
| 6,109,873 | A * | 8/2000 | Brooks | B05B 15/045 118/504 |
| 6,258,226 | B1 * | 7/2001 | Conner | C25D 5/022 204/279 |
| 6,520,838 | B1 * | 2/2003 | Shaw | 451/38 |
| 6,817,051 | B2 * | 11/2004 | Tanner | B24B 19/14 15/1.7 |
| 6,890,248 | B2 * | 5/2005 | Whitmarsh | B23Q 3/063 269/296 |
| 7,066,799 | B2 | 6/2006 | Oussaada et al. | |
| 7,074,012 | B2 * | 7/2006 | Nishimura et al. | 416/193 A |
| 7,174,599 | B2 | 2/2007 | Stiles | |
| 7,207,869 | B2 * | 4/2007 | James | B24C 3/20 451/413 |
| 7,662,020 | B2 | 2/2010 | Okada et al. | |
| 8,024,846 | B2 | 9/2011 | Luna et al. | |
| 8,105,133 | B2 | 1/2012 | Jayabalan | |
| 2003/0027495 | A1 * | 2/2003 | Shaw | B24C 1/04 451/29 |
| 2004/0043231 | A1 * | 3/2004 | Tanner | 428/469 |
| 2005/0227589 | A1 * | 10/2005 | Oussaada | C23C 4/01 451/29 |
| 2006/0194526 | A1 | 8/2006 | Bolz et al. | |
| 2009/0173418 | A1 * | 7/2009 | Jayabalan | 150/166 |
| 2009/0282677 | A1 * | 11/2009 | Korn et al. | 29/889.1 |
| 2010/0288398 | A1 | 11/2010 | Sroka et al. | |
| 2011/0068010 | A1 | 3/2011 | Garimella et al. | |

OTHER PUBLICATIONS

Singapore Search Report and Written Opinion for Singapore Patent Application No. 201204068-9 dated Apr. 15, 2013.

International Preliminary Report on Patentability for International Application No. PCT/US2013/040840 mailed Dec. 11, 2014.

* cited by examiner

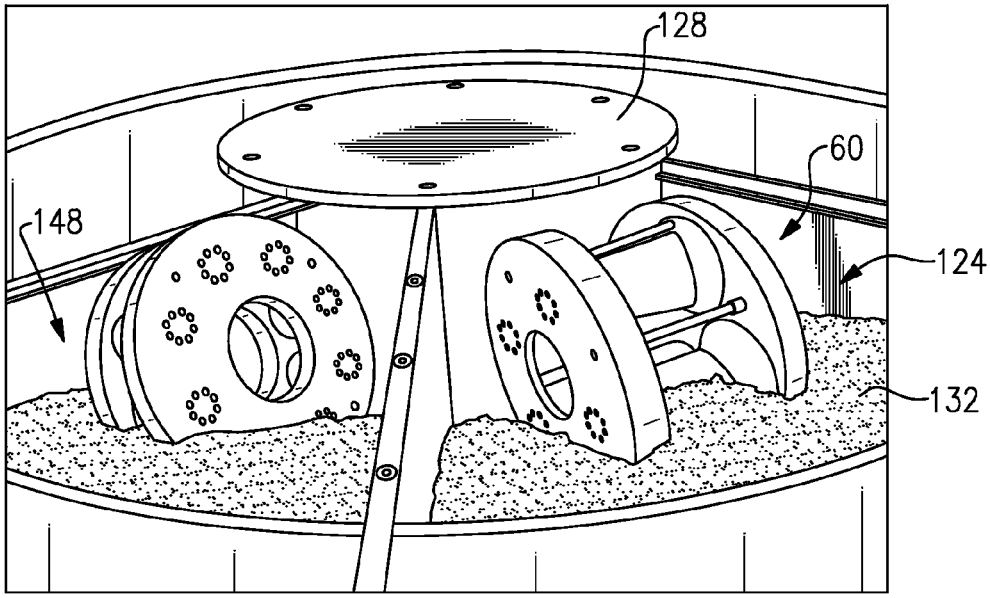
FIG.8
FIG.9
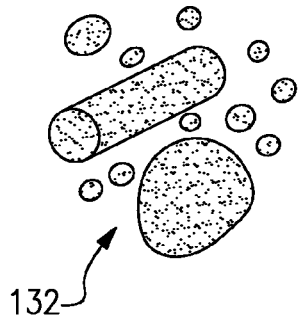
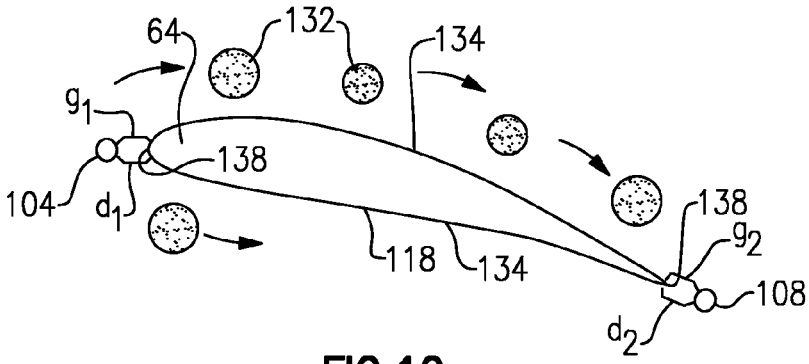
FIG.10

POLISHING ASSEMBLY AND METHOD FOR POLISHING USING A PLATFORM AND BARRIER IN A TUMBLING PROCESS

CROSS-REFERENCE TO RELATED APPLICATIONS

This application claims priority to Singapore Patent Application No. 201204068-9, which was filed on 1 Jun. 2012 and is incorporated herein by reference.

BACKGROUND

This disclosure relates generally to polishing a component and, more particularly, to protecting selected areas of a component during polishing.

Many components are polished, including used components and newly-manufactured components. As an example, used gas turbine engine airfoils are often polished to restore their aerodynamic efficiency. Polishing the components enhance their performance within the gas turbine engine. Polishing operations may include hand or machine blending, tumbling, or vibratory polishing.

Material is removed from components during polishing. Removing material from some areas of components is undesirable. For example, excessive removal of material from an airfoil leading edge or an airfoil trailing edge may render the component unsuitable for further use.

SUMMARY

A method of component polishing according to an exemplary aspect of the present disclosure includes, among other things, polishing a component and protecting portions of the component during the polishing using a barrier spaced from the component. The barrier is configured to move together with the component during the polishing.

In a further non-limiting embodiment of the foregoing method of component polishing, the method may include holding the component within a fixture. A position of the component relative to the fixture is selectively adjustable.

In a further non-limiting embodiment of either of the foregoing methods of component polishing, the method may include adjusting the position of the component within the fixture to one of a plurality of possible fixed positions to change how the media interfaces with the component.

In a further non-limiting embodiment of any of the foregoing methods of component polishing, the polishing may comprise vibratory polishing the component using a media.

In a further non-limiting embodiment of any of the foregoing methods of component polishing, the barrier may be spaced from the component a distance that is less than a thickness of a media used in the polishing.

In a further non-limiting embodiment of any of the foregoing methods of component polishing, the method may include holding the component and at least one other component within a fixture.

In a further non-limiting embodiment of any of the foregoing methods of component polishing, the method may include holding first ends of the component and the barrier within a first platform, and holding opposing second ends of the component and the barrier within a second platform.

A base structure of a polishing assembly according to an exemplary aspect of the present disclosure includes, among other things, a platform configured to engage a component, and a barrier extending from the platform. The barrier is spaced from the component when the platform engages the component. The barrier is configured to move together with the component during a polishing process.

In a further non-limiting embodiment of the foregoing base structure, the platform may be held within a fixture, and the rotational position of the platform relative to the fixture may be selected from one of a plurality of fixed positions.

In a further non-limiting embodiment of either of the foregoing base structures, the polishing process may be a vibratory polishing process.

In a further non-limiting embodiment of any of the foregoing base structures, the platform and at least one other platform may be held within a support.

In a further non-limiting embodiment of any of the foregoing base structures the platform may be held within a recessed area of the support, and each of the at least one other platforms may be held within another recessed area of the support.

In a further non-limiting embodiment of any of the foregoing base structures, a pin associated with each platform may be received within an aperture to fix a rotational position of the platform relative to the support.

In a further non-limiting embodiment of any of the foregoing base structures, the pin may extend from the associated platform and the support establishes the aperture.

A polished component according to an exemplary aspect of the present disclosure includes, among other things, a component having first surfaces and second surfaces. The first surfaces were directly contacted by media during a polishing. A barrier was spaced from the second surfaces to limit contact between the media and the second surfaces during the polishing.

In a further non-limiting embodiment of the foregoing polished component, the component is a turbomachine component.

In a further non-limiting embodiment of either of the foregoing polished components, the first surfaces were directly contacted by media during a vibratory polishing.

In a further non-limiting embodiment of any of the foregoing polished components, the component may be an airfoil.

In a further non-limiting embodiment of any of the foregoing polished components, the component may be an integrally bladed rotor.

DESCRIPTION OF THE FIGURES

The various features and advantages of the disclosed examples will become apparent to those skilled in the art from the detailed description. The figures that accompany the detailed description can be briefly described as follows:

FIG. 8 shows the polishing assembly of FIG. 2 within a vibratory polisher.

FIG. 9 shows a media suitable for use within the FIG. 8 vibratory polisher.

FIG. 10 shows a schematic section view of a component held within the polishing assembly and disposed within the media of FIG. 9.

DETAILED DESCRIPTION

Figure 1:
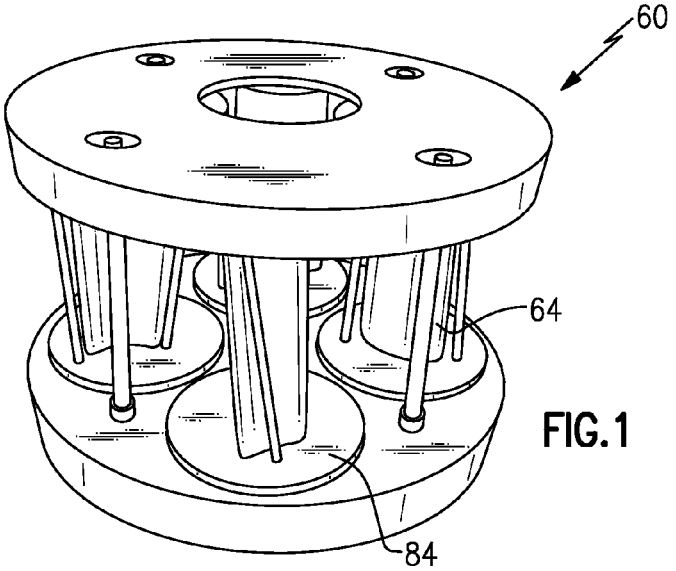
FIG. 1 shows a perspective view of an example polishing assembly with components installed.
Figure 2:
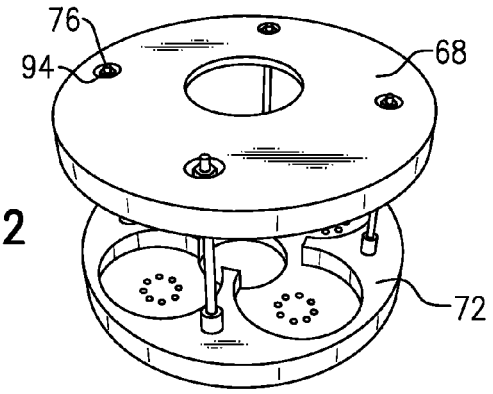
FIG. 2 shows the polishing assembly of FIG. 1 with components removed.
Figure 3:
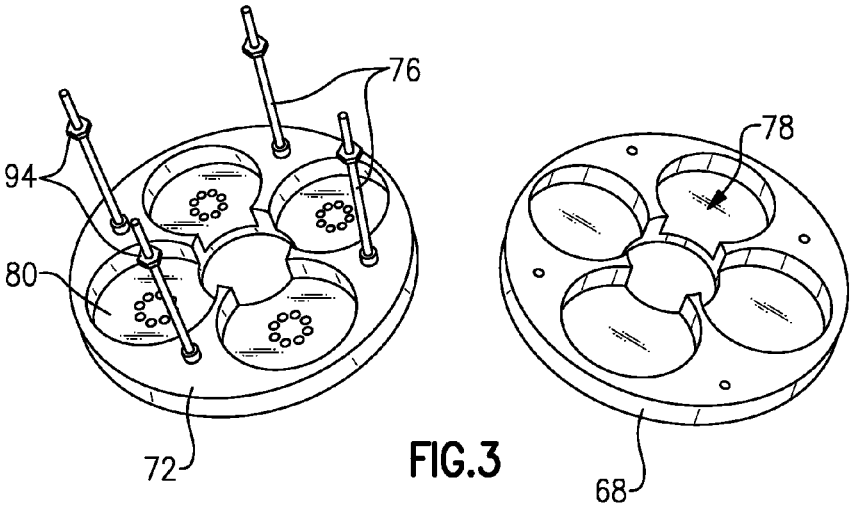
FIG. 3 shows a partially disassembled polishing assembly of FIG. 1.
Figure 4:
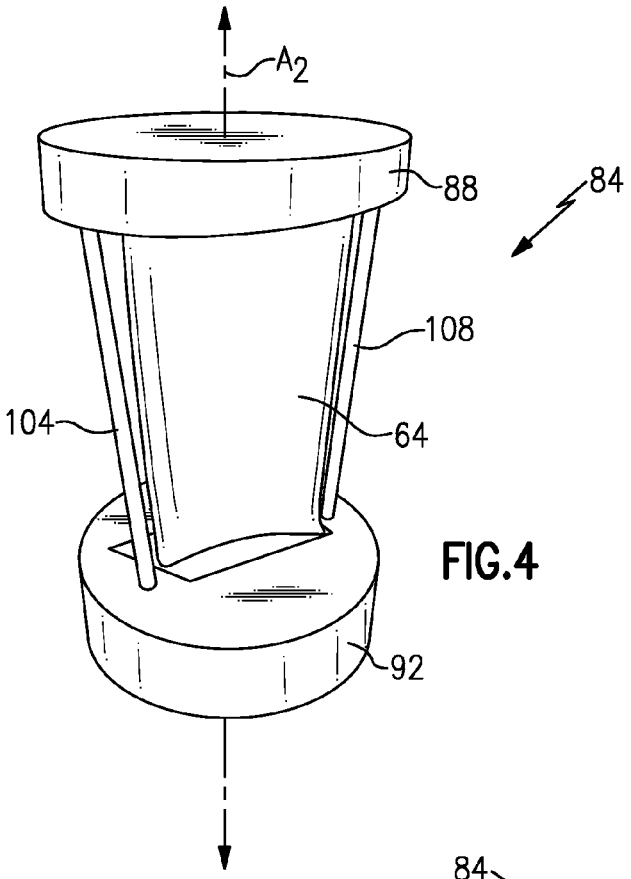
FIG. 4 shows a base structure assembly for use with the polishing assembly of FIG. 1.
Figure 5:
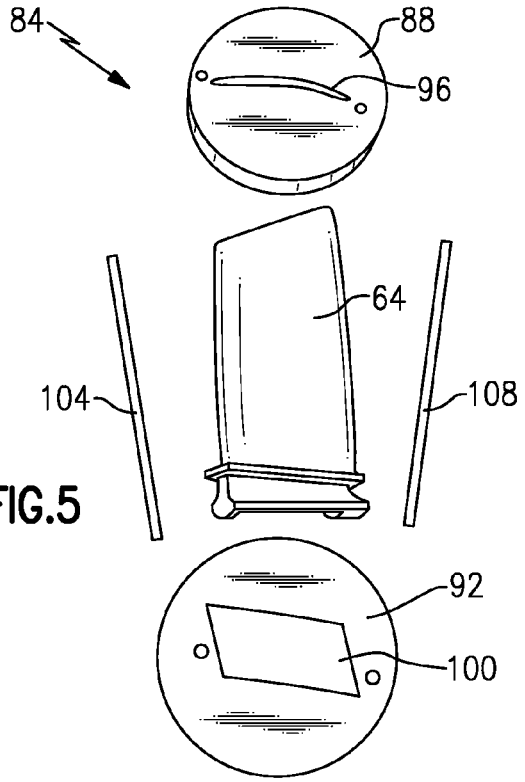
FIG. 5 shows an exploded view of the base structure assembly of FIG. 3.
Figure 6:
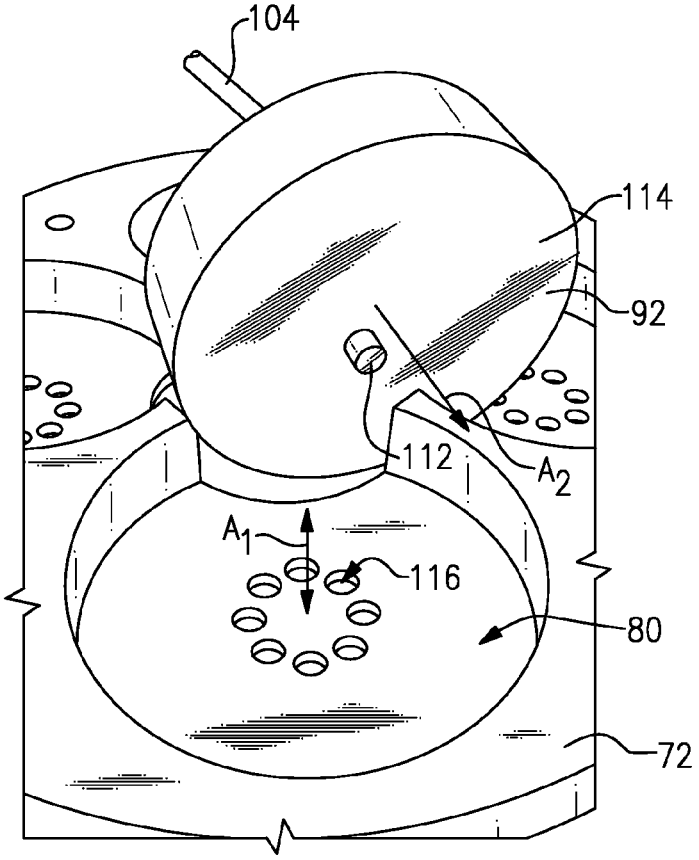
FIG. 6 shows a close-up view of a portion of the polishing assembly of FIG. 1 and an end view of the base structure of FIG. 4.
Figure 7:
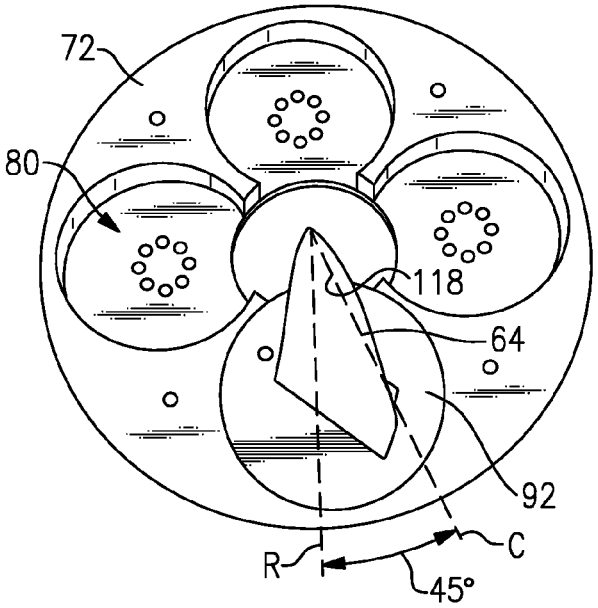
FIG. 7 shows a top view of a portion of the polishing assembly of FIG. 1 with a base structure of FIG. 4.

Referring FIGS. 1-3, an example polishing assembly 60 holds components 64 of a gas turbine engine during a polishing operation. In this example, the components 64 are blades from a high pressure compressor of the gas turbine engine. The polishing assembly holds other types of components in other examples, such as an integrally bladed rotor of the gas turbine engine.

During operation of the gas turbine engine, the components 64 are eroded and worn. The components 64 are periodically removed from the gas turbine engine and polished to improve the performance of the components 64 after they are reinstalled into the gas turbine engine. During the polishing, the component may be considered a workpiece. Vibratory polishing is one technique used to polish workpieces. Other polishing techniques are used in other examples.

The polishing assembly 60 holds some of the components 64 during the polishing. The example polishing assembly 60 protects portions of the components 64 during the polishing to limit material removal from some areas of the components 64.

The polishing assembly 60 includes a first support 68 and a second support 72. The first support 68 connects to the second support 72 with threaded rods 76. The first support 68 includes recessed areas 78. The second support 72 includes recessed areas 80 corresponding to the recessed areas 78 in the first support 68. When the first and second supports 68 and 72 are connected, the recessed areas 78 are opposed to the corresponding recessed areas 80.

The recessed areas 78 and the recessed areas 80 each receive opposing ends of a base structure 84. The base structure 84 is the portion of the polishing assembly 60 that interfaces directly with the components 64. In this example, the polishing assembly 60 includes four base structures 84. Each base structure 84 holds a single one of the components 64. Thus, the polishing assembly 60 holds four components 64.

Referring now to FIGS. 4-7 with continuing reference to FIGS. 1-3, the example base structure 84 includes a first platform 88 and a second platform 92. The first platform 88 has an opening 96 that receives a radially outer end of the component 64. The second platform 92 includes an opening 100 that receives a radially inner end of the component 64.

A first barrier 104 and a second barrier 108 extend from the first platform 88 to the second platform 92. The barriers 104 and 108 are held within the platforms 88 and 92 such that the barriers 104 and 108 are spaced from a leading edge and a trailing edge of the component 64, respectively. The barriers 104 and 108 move together with the component 64 during polishing.

To prepare the component 64 for polishing, the component 64 and the barriers 104 and 108 are placed within the first and second platforms 88 and 92. The second platform 92 of the base structure 84 (which is now holding the component 64) is then placed within one of the recessed areas 80 of the second support 72. The first support 68 is then positioned over the threaded rods 76 as the first platform 88 of the base structure 84 is received within one of the recessed areas 78. Nuts 94 are then rotated about the threaded rods 76 to move the first support 68 and the second support 72 toward each other. Although nuts 94 and threaded rods 76 are shown, other examples may utilize other structures to hold the relative positions of the first and second supports 68 and 72, such as, for example, clamps, latches, etc.

The base structure 84 is essentially clamped between the first and second supports 68 and support 72, which limits movement of the base structure 84 along an axis $A_1$ relative to the first and second supports 68 and 72. The first support 68 contacts the walls of the recessed area 78 to limit movement of the base structure 84 radially away from the axis $A_1$. The second support 72 contacts the walls of the recessed area 80 to limit movement of the base structure 84 radially away from the axis $A_1$. Holding the position of the first support 68 and the second support 72 thus holds the base structure 84.

In this example The first platform 88 and the second platform 92 are made from a rubber material. Rubber beneficially holds the component 64 with relatively little risk of damaging the component 64. Also, no mechanical fasteners are used to secure the component 64 or the barriers 104 and 108 within the first platform 88 or the second platform 92. The areas of the components 64 that directly receive the component 64 can be sized to securely grip and hold the components 64 during polishing without additional mechanical fasteners. The component 64 and the barriers 104 and 108 are held in position due to the clamping of the first support 68 and the second support 72. Other examples may include some sort of mechanical fastener utilized to secure the component 64 and the barriers 104 and 108.

In this example, a pin 112 (FIG. 6) extends from a bottom surface 114 of the second platform 92. The pin 112 is received within one of a plurality of apertures 116 when the second platform 92 is positioned within the recessed area 80. The apertures 116 are circumferentially distributed about an axis $A_1$, which is aligned with an axis $A_2$ of the base structure 84 when the pin 112 is received within one of the apertures 116. The recessed area 80 is circular. Contact between the pin 112 and the edges of the aperture 116 prevents the second platform 92, and thus the base structure 84, from rotating within the recessed area 80 about the axes $A_1$ and $A_2$.

The orientation of the component 64 (and the base structure 84) relative to other portions of the polishing assembly 60 can be controlled by selectively positioning the pin 112 in one of the plurality of apertures 116. In so doing, an angle of the component 64 within the polishing assembly 60 can be selected.

In this example, the component 64 has a chord C, and the chord C is held within the polishing assembly 60 at an angle of about 45 degrees relative to a radially aligned position. Other angles may be selected depending on specific polishing requirements. For example, an angle of about 90 degrees may be selected if exposing a pressure side 118 of the component 64 is desired.

Referring now to FIGS. 8-10 with continuing reference to FIGS. 1-6, the polishing assembly 60 holding four of the components 64 is utilized, in this example, when vibratory polishing the components 64.

During a polishing process, the polishing assembly 60, together with the components 64, is held within a bin 124 of a vibratory polishing machine 128. The bin 124 is filled with polishing media 132. The vibratory polishing machine 128 is then vibrated rapidly to move the polishing media 132 against select surfaces of the component 64. The polishing assembly 60 is submerged beneath the polishing media 132 during some or all of the polishing.

In this example, the media 132 is a ceramic material. The media 132 includes four distinct sizes. Other examples may exclusively use media having a relatively consistent size. Other examples may use other types of media.

In this example, the barriers 104 and 108 are spaced from the component 64 a distance $d_1$ and $d_2$. The barriers 104 and 108 are positioned at the leading and trailing edges of the component 64. The barriers are steel pins in this example. The distances $d_1$ and $d_2$ are smaller than the smallest dimensions of each of the four sizes of the media 132. Thus, none of the media 132 is unable to through the gaps $g_1$ and $g_2$ between the barriers 104 and 108 and the component 64.

In other examples, the distances $d_1$ and $d_2$ are smaller than some, but not all, of the four sizes of media 132. Thus, some, but not all, of the four sizes of media 132 are able to move through the gaps $g_1$ and $g_2$.

Preventing media 132 from moving into the gaps $g_1$ and $g_2$ prevents the media 132 from removing material from the leading edge and the trailing edge of the component 64 during the polishing. Other types of barriers may be positioned in other areas relative to the component 64 depending on polishing requirements.

Figure 11:
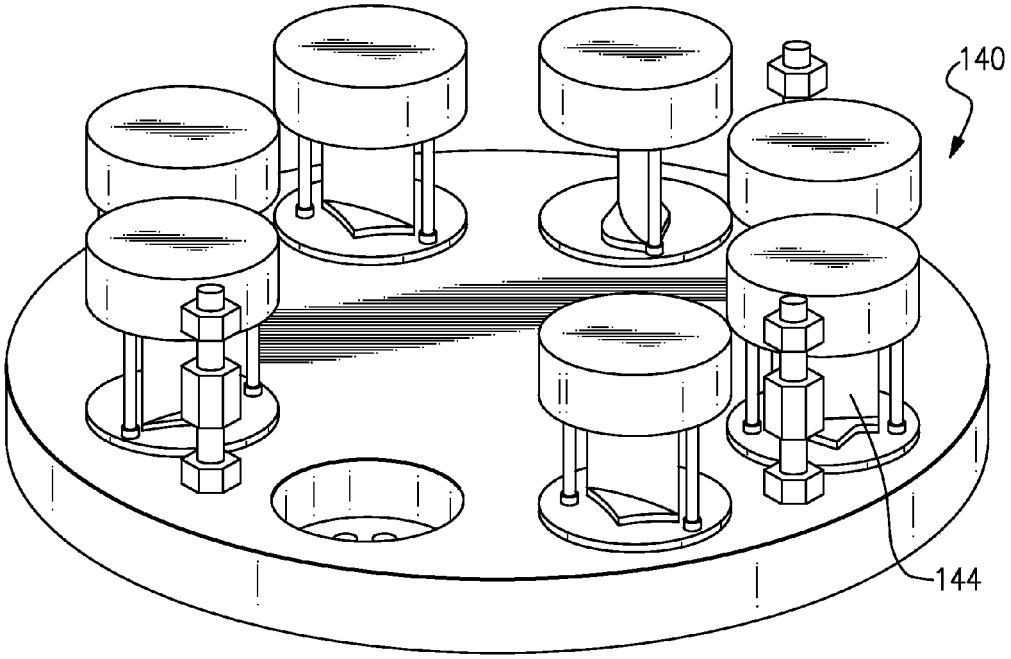
FIG. 11 shows a partially assembled view of another example polishing assembly.

After the polishing, the component 64 is removed from the base structure 84. The component 64 now includes first surfaces 134 that were directly contacted by media 132 during a polishing operation and second surfaces 138 that were not substantially contacted by media 132 during a polishing operation. The barriers 104 spaced from the second surfaces 138 protect the second surfaces 138 and limit contact between the media 132 and the second surfaces 138 during the polishing Referring to FIG. 11, another example polishing assembly 140 is configured to hold eight components 144. The polishing assembly 140 may be positioned within another bin 148 of the vibratory polishing machine 128 such that the components 144 and the components 64 are polished at the same time.

Figure 12:
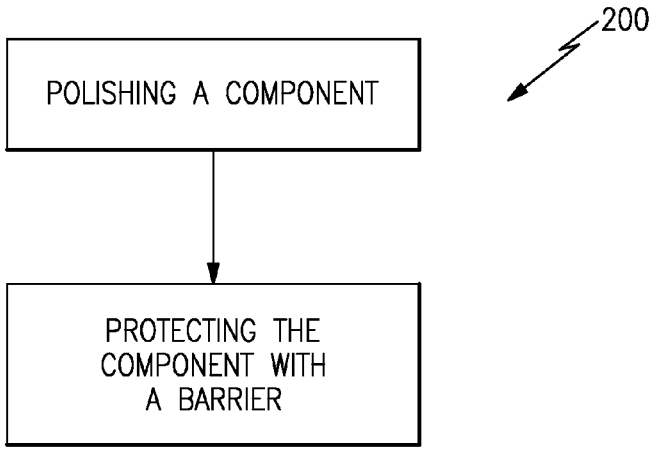
FIG. 12 shows an example component polishing method.

Referring to FIG. 12, an example component polishing method 200 according to some example of this disclosure include a step 210 of polishing a component. The method 200 also includes a step 220 of protecting portions of the component during the polishing using a barrier spaced from the component. The barrier is configured to move together with the component during the polishing.

Features of the disclosed examples include a fixture assembly for polishing that enables selective adjustment of the component within the fixture, and particularly the angle of the component within the fixture. Another feature of the disclosed examples includes barriers protecting areas of the component without directly contacting the component.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A component polishing method, comprising:

polishing a component;

protecting portions of the component during the polishing using a barrier spaced from the component, wherein the barrier is configured to move together with the component during the polishing;

holding the component and the barrier within a fixture during the polishing in one of a plurality of possible fixed positions, the component and the barrier selectively adjustable together relative to the fixture to the plurality of possible fixed positions within the fixture; and prior to the polishing, adjusting the component and the barrier together relative to the fixture from the one of the plurality of possible fixed positions to another of the plurality of possible fixed positions, the adjusting changing how a media interfaces with the component and the barrier during the polishing, wherein the barrier and the component move together relative to the fixture during the adjusting.

2. The component polishing method of claim 1, wherein the polishing comprises vibratory polishing the component using a media held within a bin, wherein the component, the barrier, and the fixture are configured to move together relative to the bin during the polishing.

3. The component finishing method of claim 2, wherein the barrier is spaced from the component a distance that is less than a thickness of a media used in the polishing.

4. The component finishing method of claim 1, including holding the component and at least one other component within the fixture.

5. The component finishing method of claim 1 including holding first ends of the component and the barrier within a first platform and holding opposing second ends of the component and the barrier within a second platform.

6. a base structure of a polishing assembly, comprising:

a platform configured to engage a component; a barrier extending from the platform, the barrier spaced from the component when the platform engages the component, the barrier configured to move together with the component during a polishing process, wherein the platform is held within a support , and a position of the platform and the barrier relative to the support is selected from one of a plurality of possible fixed positions, the plurality of possible fixed positions defined by the platform , the support, or both, wherein a pin associated with each platform is received within one of a plurality of apertures to limit rotation of the barrier and the platform relative to the support, the plurality of apertures providing the plurality of possible fixed positions.

7. The base structure of claim 6, wherein the polishing process is a vibratory polishing process using media held within a bin, wherein the platform, the barrier, and the component are configured to move together during the polishing process relative to the bin.

8. The base structure of claim 6, wherein the platform is held within a recessed area of the support, and each of the at least one other platforms is held within another recessed area of the support.

9. The base structure of claim 6, wherein the pin extends from the associated platform and the support establishes the plurality of apertures.

10. A polishing component, comprising:

A component having first surfaces and second surfaces, wherein the first surfaces were directly contacted by media during a polishing and a barrier extending from a platform held in a fixture was spaced from the second surfaces to limit contact between the media and the second surfaces during the polishing, wherein the component and the barrier were held within the fixture during the polishing, and wherein the component and the barrier are adjustable together relative to the fixture to one of a plurality of fixed positions, wherein a pin associated with each platform is received within one of a plurality of apertures to limit rotation of the barrier and the platform relative to the fixture, the plurality of apertures providing the plurality of possible fixed positions.

11. The polished component of claim 10, wherein the component is a turbomachine component.

12. The polished component of claim 10, wherein the first surfaces were directly contacted by media during a vibratory polishing, the media held within a bin, wherein the component, the barrier, and the fixture are configured to move relative to the bin during the vibratory polishing.

13. The polished component of claim 10, wherein the component is an airfoil.

14. The polished component of claim 10, wherein the component is an integrally bladed rotor.

15. the component polishing method of claim 1, wherein the barrier and the component rotate together relative to the fixture during the adjusting.

16. The component polishing method of claim 5, wherein the plurality of possible fixed positions are defined within the fixture, the first platform, or both, wherein the plurality of possible fixed positions are distributed annularly about an axis.

17. The base structure of claim 6, wherein the platform and the barrier are moveable together relative to the support between the plurality of possible fixed positions, wherein the plurality of possible fixed positions are distributed annularly about an axis.

* * * * *